US006517437B1

(12) United States Patent
Wells et al.

(10) Patent No.: US 6,517,437 B1
(45) Date of Patent: Feb. 11, 2003

(54) CASINO GAMING APPARATUS WITH MULTIPLE DISPLAY

(75) Inventors: William Wells, Reno, NV (US); Joseph Kaminkow, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/943,788

(22) Filed: Aug. 31, 2001

(51) Int. Cl.[7] ..... A63F 9/24

(52) U.S. Cl. ..... 463/30; 463/20; 463/31; 273/143 R

(58) Field of Search ..... 463/12, 13, 16, 463/17, 18, 19, 20, 21, 22, 30, 31; 273/143 R, 138.1, 138.2

(56) References Cited

U.S. PATENT DOCUMENTS

| | | | | |
|---|---|---|---|---|
| 4,517,558 A | | 5/1985 | Davids | 340/700 |
| 4,621,814 A | | 11/1986 | Stepan et al. | 273/138 A |
| 5,216,504 A | | 6/1993 | Webb et al. | 358/139 |
| 5,848,932 A | | 12/1998 | Adams | 463/20 |
| 5,851,148 A | | 12/1998 | Brune et al. | 463/25 |
| 6,027,115 A | | 2/2000 | Griswold et al. | 273/143 R |
| 6,135,884 A | * | 10/2000 | Hedrick et al. | |
| 6,254,481 B1 | * | 7/2001 | Jaffe | |
| 6,309,300 B1 | | 10/2001 | Glavich | 463/26 |
| D450,096 S | | 11/2001 | Legras et al. | D21/385 |
| D450,310 S | | 11/2001 | Hedrick et al. | D14/172 |
| 6,315,666 B1 | | 11/2001 | Mastera et al. | 463/31 |
| 6,319,124 B1 | | 11/2001 | Baerlocher et al. | 463/20 |
| 2002/0002078 A1 | * | 1/2002 | Jaffe | |
| 2002/0025852 A1 | * | 2/2002 | Alcorn et al. | |
| 2002/0065732 A1 | * | 5/2002 | Stephan | |

FOREIGN PATENT DOCUMENTS

| | | | |
|---|---|---|---|
| JP | 08-206277 | * | 8/1996 |

* cited by examiner

*Primary Examiner*—Michael O'Neill
(74) *Attorney, Agent, or Firm*—Marshall, Gerstein & Borun

(57) ABSTRACT

A gaming apparatus may comprise a cabinet having a first interior portion and a second interior portion, the cabinet further including an opening defining a viewing area. A partially reflective optical device may be supported inside the cabinet and positioned to transmit light from the first interior portion to the viewing area and reflect light from the second interior portion to the viewing area. A first display may be supported inside the cabinet in the first interior portion, and a second display may be supported inside the cabinet in the second interior portion. A controller may be operatively coupled to the first and second displays, the controller comprising a processor and a memory operatively coupled to the processor. The controller may be programmed to allow a person to make a wager, to cause a first image associated with a casino game to be selectively generated on the first display, and a second image associated with a casino game to be selectively generated on the second display, and to determine an outcome of the casino game represented by the first and second images and to determine a value payout associated with the outcome of the casino game.

35 Claims, 13 Drawing Sheets

CASINO GAMING APPARATUS WITH MULTIPLE DISPLAY

BACKGROUND OF THE INVENTION

This invention relates to gaming apparatus that is capable of displaying output from multiple gaming displays in a single viewing area, the gaming apparatus allowing customers to play casino games such as slots, poker, and blackjack.

Casino gaming apparatus having multiple displays are generally known in the art. Such gaming apparatus is typically provided with a cabinet having primary and secondary viewing areas. A first display is mounted inside the primary viewing area of the cabinet, and may be a mechanical display, such as a series of stepper wheels, or an electronic display, such as a video display that is capable of generating video images. Whether mechanical or electronic, the first display may be capable of generating images associated with a game, such as poker, blackjack, slots, keno, or bingo.

Conventional casino gaming apparatus may further incorporate one or more second displays mounted in the secondary viewing area of the cabinet. The second displays may also be of the mechanical or electronic type, and are capable of generating additional images associated with a casino game. The second display is often used as a bonus display that is activated only for a bonus mode, however it may also be used as an alternative primary display.

The primary and secondary viewing areas are spaced from each other, requiring a customer to shift his point of vision between the two. For example, the primary viewing area may be located generally at a customer's eye level, while the second viewing area may be located in a top portion of the cabinet. As a result, the customer must turn his head up and down between the two viewing areas as play alternates between the first and second displays, resulting in increased fatigue to the customer.

In addition, conventional gaming apparatus typically generates a flat or two-dimensional image. Some devices are known that incorporate parabolic mirrors in an attempt to produce a three-dimensional image having depth. The image produced by the mirrors, however, is often distorted, particularly at the edges of the image, making the images hard to view for extended periods of time. In addition, such apparatus is capable of producing only a relatively small viewable image.

SUMMARY OF THE INVENTION

The invention is directed to a gaming apparatus that may comprise a cabinet having a first interior portion and a second interior portion, the cabinet further including an opening defining a viewing area. A partially reflective optical device may be supported inside the cabinet and positioned to transmit light from the first interior portion to the viewing area and reflect light from the second interior portion to the viewing area. A first display may be supported inside the cabinet in the first interior portion, and a second display may be supported inside the cabinet in the second interior portion. A controller may be operatively coupled to the first and second displays, the controller comprising a processor and a memory operatively coupled to the processor. The controller may be programmed to allow a person to make a wager, to cause a first image associated with a casino game to be generated on at least one of the first and second displays, and to determine an outcome of the casino game represented by the first image and to determine a value payout associated with the outcome of the casino game.

The image may represent a casino game selected from the group of casino games consisting of poker, blackjack, slots, keno and bingo, in which case the image may comprise an image of at least five playing cards if the casino game comprises poker; the image may comprise an image of a plurality of slot machine reels if the casino game comprises slots; the image may comprise an image of a plurality of playing cards if the casino game comprises blackjack; the image may comprise an image of a plurality of keno numbers if the casino game comprises keno; and the image may comprise an image of a bingo grid if the casino game comprises bingo.

The controller may be programmed to operate in a normal mode, in which an image is generated by one of the first and second displays, and a bonus mode, in which an image is generated by the other of the first and second displays. The controller may also be programmed to cause image components to be generated simultaneously by the first and second displays to create a composite image.

The features and advantages of the present invention will be apparent to those of ordinary skill in the art in view of the detailed description of various embodiments, which is made with reference to the drawings, a brief description of which is provided below.

DETAILED DESCRIPTION OF VARIOUS EMBODIMENTS

Figure 1:
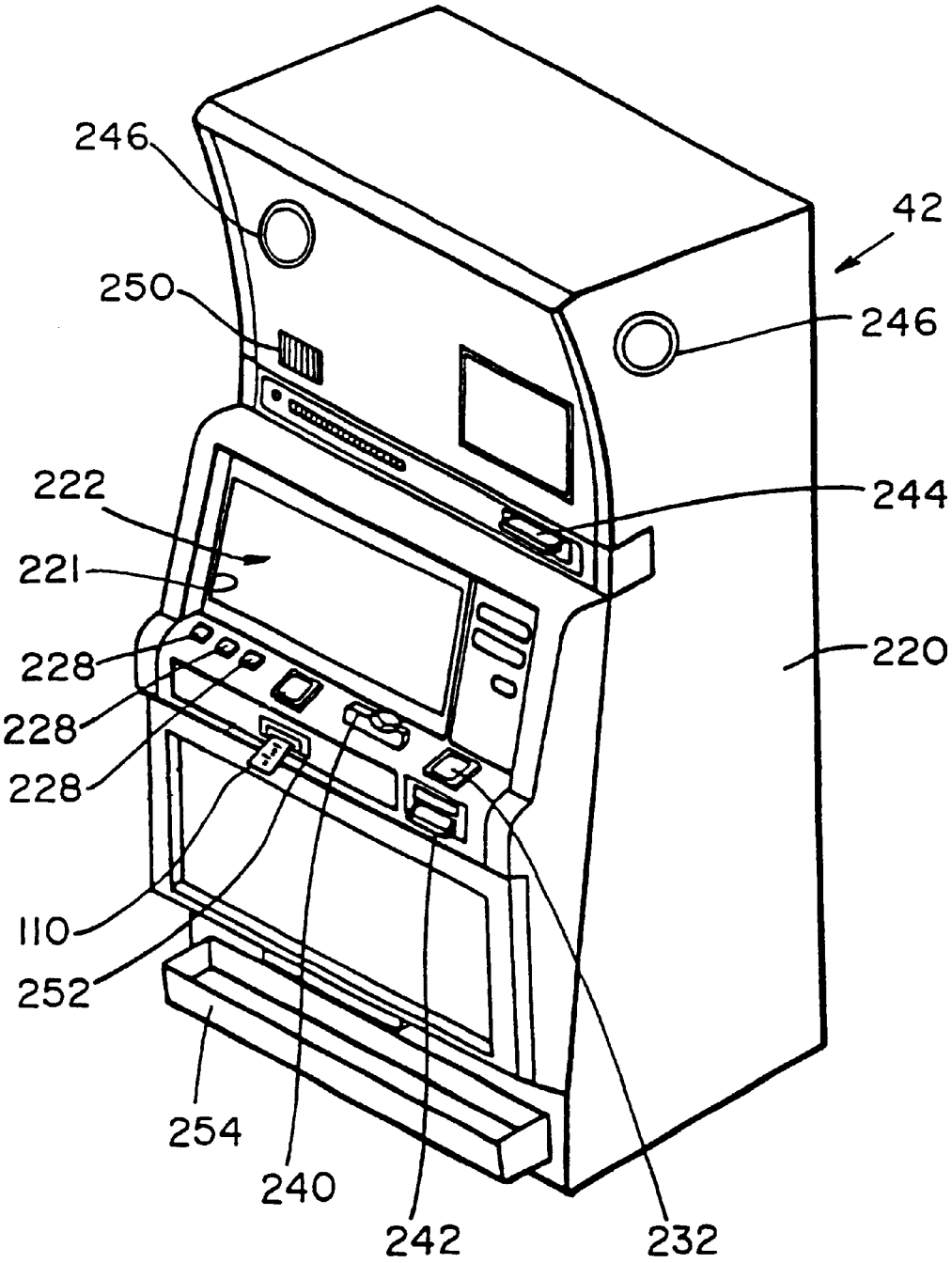
FIG. 1 is a perspective view of an embodiment of a gaming apparatus in accordance with the present invention.

A gaming apparatus 42 incorporating the teachings of the present invention is schematically illustrated at FIG. 1. The gaming apparatus 42 may be any type of casino gaming apparatus and may have various different structures and methods of operation. For exemplary purposes, a particular type of gaming apparatus 42 is described below, but it should be understood that numerous other types may be provided.

Referring to FIG. 1, the casino gaming apparatus 42 may include a cabinet 220 having an opening 221. The opening 221 defines a viewing area 222 for observing multiple displays, as described in greater detail below. The gaming apparatus 42 may also include a variety of input devices, such as a plurality of buttons 228 that a customer may actuate to make wagers and game-specific selections such as hold or discard decisions, a slots spin button 232, and/or any other type of input device. Additional inputs may be provided in the form of a touchscreen (not shown) positioned across the opening 221.

The casino gaming apparatus 42 may include a variety of currency- or value-accepting mechanisms that may be disposed on the front of the gaming apparatus 42 or in any other suitable location. The value-accepting mechanisms may include any device that can accept value from a customer. As used herein, the term "value" may encompass gaming tokens, coins, paper currency, ticket vouchers, and any other suitable object representative of value. For example, the value-accepting mechanisms may include a coin acceptor 240 that accepts coins or tokens; a bill acceptor 242 that accepts and validates paper currency; a card or ticket reader 244 that accepts coupons, credit cards, printed cards, smart cards, ticket vouchers, etc.; and any other device that may accept a medium of value. In addition, the card or ticket reader 244 may accept a player tracking card.

The gaming apparatus 42 may include additional features to enhance a player's game-playing experience, such as one or more audio speakers 246, a sound-generating circuit 248 (FIG. 2), and an aroma dispenser 250. The audio speakers 246 may provide various forms of sound relevant to the casino game that the player is playing. For example, the speakers 246 may generate audio representing sounds such as the noise of spinning slot machine reels, a dealer's voice, music, announcements or any other suitable audio related to a casino game. The aroma dispenser 250, which may be mounted above the viewing area 222 or in any other suitable location on the gaming apparatus 42, may be manufactured by MicroScent, DigiScents, or Aromajet.

The gaming apparatus 42 may also include a printer 252 disposed on the front of the gaming apparatus 42 or in any other suitable location. The printer 252 may be used, for example, to print the ticket vouchers 110. The gaming apparatus 42 may also include a payout tray 254 of the type provided on slot machines, for example.

Figure 3A:
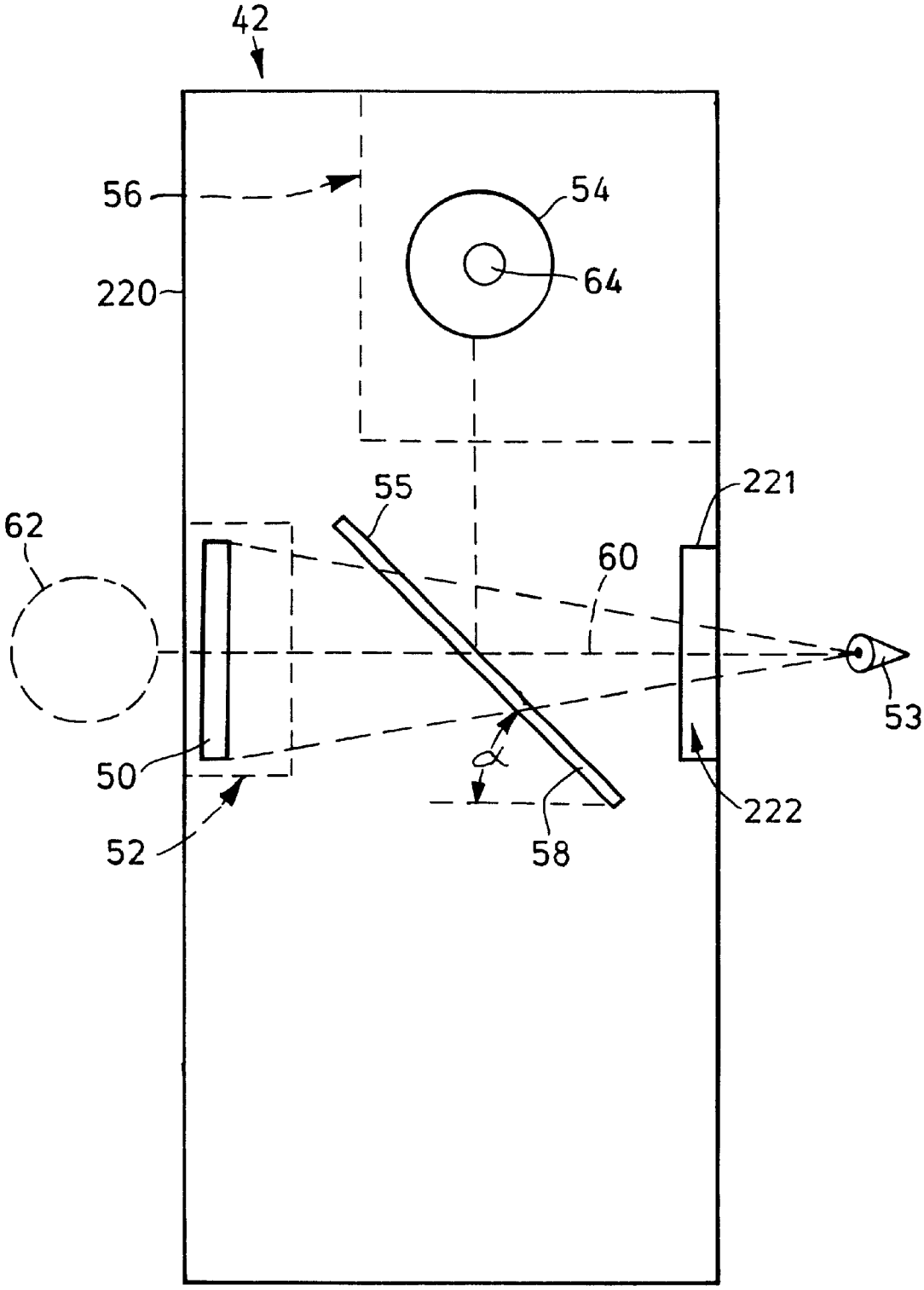
FIG. 3A is a schematic side view of the gaming apparatus illustrated at FIG. 1 incorporating a mechanical display and an electronic display.
Figure 3B:
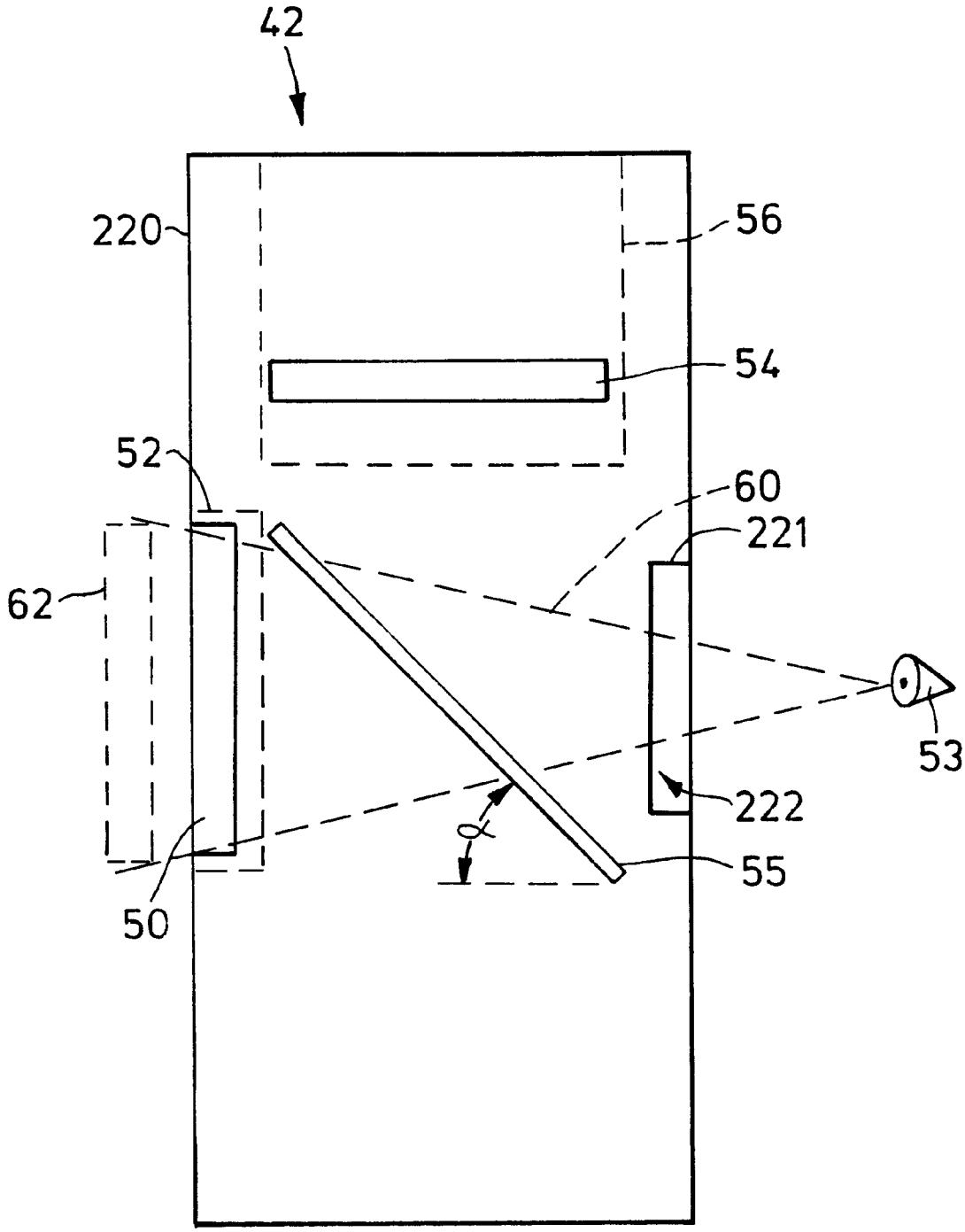
FIG. 3B is a schematic side view of the gaming apparatus illustrated at FIG. 1 incorporating two electronic displays.

The gaming apparatus 42 may further include multiple displays for showing various game outcomes. As shown in FIGS. 3A and 3B, a first display 50 may be disposed in a first interior portion 52 of the cabinet 220, so that the first display 50 is generally aligned with the viewing area 222 and an observation point 53 at which a customer's eyes will normally be positioned. A second display 54 may be disposed in a second interior portion 56 of the cabinet 220. Both the first and second displays 50, 54 may show outcomes and information associated with one or more casino games that the casino customer may play.

In the embodiment illustrated in FIG. 3A, the first display 50 is an electronic display, such as a CRT or LCD screen, while the second display 54 is a mechanical display, such as a series of stepper reels or a spinning dial. It will be appreciated, however, that the displays may be reversed, so that the first display 50 is a mechanical display and the second display 54 is an electronic display. In addition, the first and second displays 50, 54 may be of the same type. For example, the first and second displays 50, 54 both may be electronic displays, as shown in FIG. 3B, or they both may be mechanical displays.

A partially reflective optical device, such as a beam splitter 58, is provided to allow both the first and second displays 50, 54 to be viewed at the viewing area 222. As best shown in FIGS. 3A and 3B, the first display 50 may be directly viewed from the observation point 53 along a path 60, while the second display 54 may not be directly viewed from the observation point 53. The beam splitter 58 may be provided with a partially reflective surface 55 to reflect an image from the second display 54 along a same path 60 to the viewing area 222. The beam splitter 58 may have a transmitted-to-reflected beam ratio of 50:50, however other ratios such as 40:60 or 30:70 may also be used.

As best shown in FIG. 3A, the beam splitter 58 may be vertically aligned with the second display 54 and horizontally aligned with the first display 50. With the components so arranged, the beam splitter 58 may be supported at an angle "a", such as 45 degrees, so that the image from the first display 50 is transmitted through the beam splitter 58 generally along the path 60, while the image from the second display 54 is reflected off of the reflective surface 55, generally along the same path 60. As a result, the beam splitter 58 creates a virtual image 62 of the second display 54 which appears to be at or near the image generated by the first display 50.

A backlight 64 may also be provided for improving visibility of the second display 54. According to the embodiment illustrated in FIG. 3A, the first display 50 is an electronic display, and therefore the image formed by the first display 50 comprises light beams which may be transmitted through the beam splitter 58. The second display 54 in FIG. 3A, however, is a mechanical display, and therefore the images produced by the second display 54 do not ordinarily comprise light beams. The backlight 64 illuminates the second display 54 so that the reflection of the image generated by the display 54 is viewable from the observation point 53.

Gaming Apparatus Electronics

Figure 2:
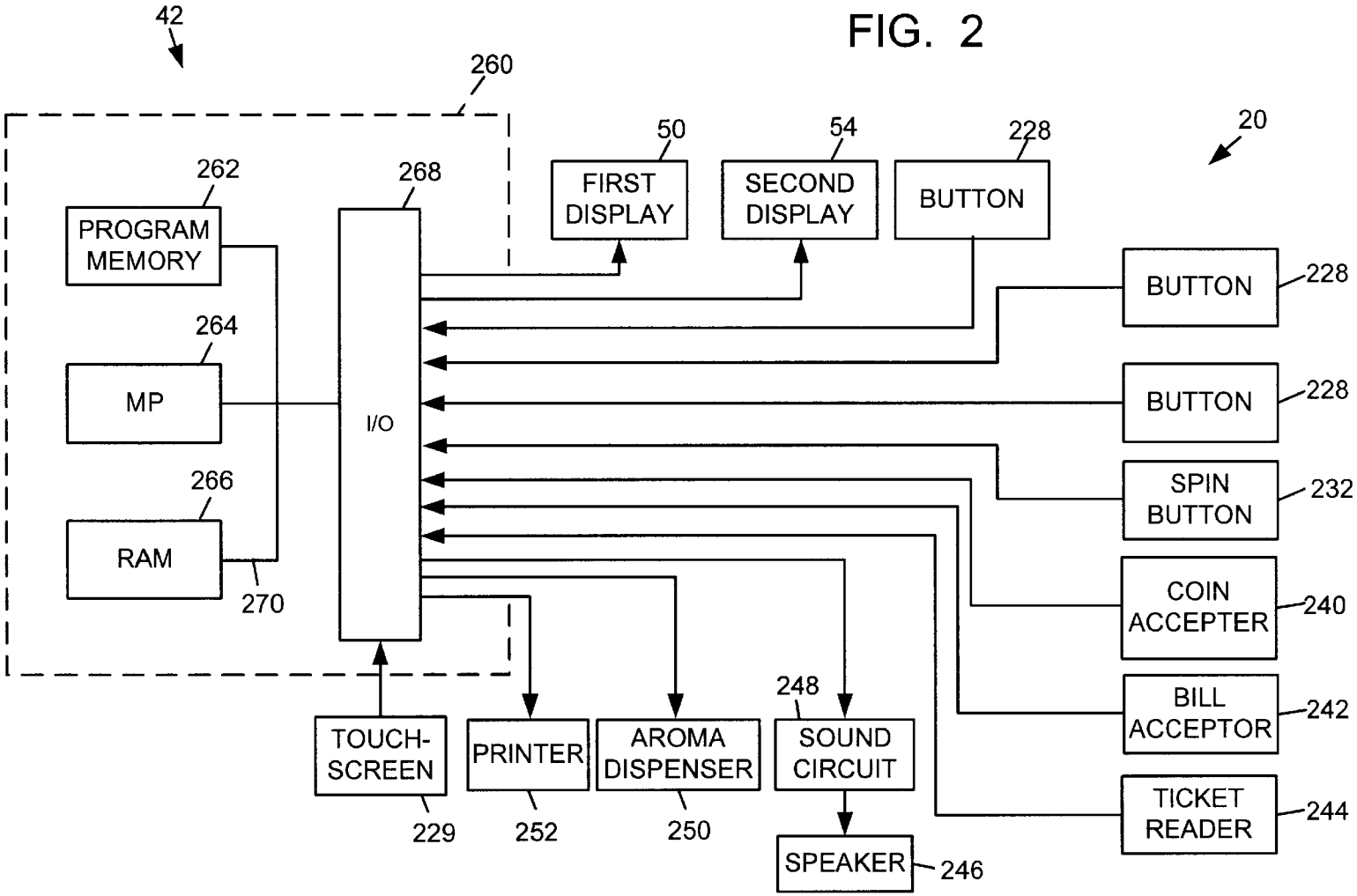
FIG. 2 is a block diagram of the electronic components of the gaming apparatus of FIG. 1.

FIG. 2 is a block diagram of a number of components that may be incorporated into the gaming apparatus 42. Referring to FIG. 2 the gaming apparatus 42 may include a controller 260 that may comprise a program memory 262 (which may be read-only-memory or programmable memory), a microcontroller or microprocessor (MP) 264, a random-access memory (RAM) 266 and an input/output (I/O) circuit 268, all of which may be interconnected via an address/data bus 270. It should be appreciated that although only one microprocessor 264 is shown, the controller 260 could include multiple microprocessors 264. Similarly, the memory of the controller 260 could include multiple RAMs 266 and multiple program memories 262. Although the I/O circuit 268 is shown as a single block, it should be appreciated that the I/O circuit 268 could include a number of different types of I/O circuits. The RAM(s) 264 and program memory(s) 262 could be implemented as semiconductor memories, magnetically readable memories, and/or optically readable memories, for example. The controller 260 may be operatively coupled to each of the components shown in FIG. 2, including the first and second displays 50, 54.

FIG. 2 also illustrates that the components shown in FIG. 1 could be connected to the I/O circuit 268 via a respective direct line or conductor. Different connection schemes could be used. For example, one or more of the components shown in FIG. 2 could be connected to the I/O circuit 268 via a common bus or other data link that is shared by a number of components. Furthermore, some of the components could be directly connected to the microprocessor 264 without passing through the I/O circuit 268.

Still further, the controller 260 may be provided as an embedded PC to drive one or more of the components, or a combination of an embedded PC and an embedded controller. For example, the PC may drive an LCD, touchscreen, smartcard, fingerprint sensor, and several other devices, while the embedded controller may drive the switches, lights, and mechanical steppers. In the alternative, the embedded PC may drive all of the components.

Overall Operation of Gaming Apparatus

One manner in which the gaming apparatus 42 may operate is described below in connection with a number of flowcharts which represent a number of portions or routines of one or more computer programs, which may be stored in one or more of the memories of the controller 260. The computer program(s) or portions thereof may be stored remotely, outside of the gaming apparatus 42, and may control the operation of the gaming apparatus 42 from a remote location. Such remote control may be facilitated with the use of a wireless connection, or by an Internet interface (not shown) that connects the gaming apparatus 42 with a remote computer (not shown) having a memory in which the computer program portions are stored via the Internet. The computer program portions may be written in any high level language such as C, C+, C++ or the like or any low-level, assembly or machine language. By storing the computer program portions therein, various portions of the memories 262, 266 are physically configured, either magnetically (e.g. in the case of a magnetic memory), electrically (e.g. in the case of a semiconductor memory) or structurally (e.g. in the case of an optical memory), in accordance with computer program instructions.

Figure 4:
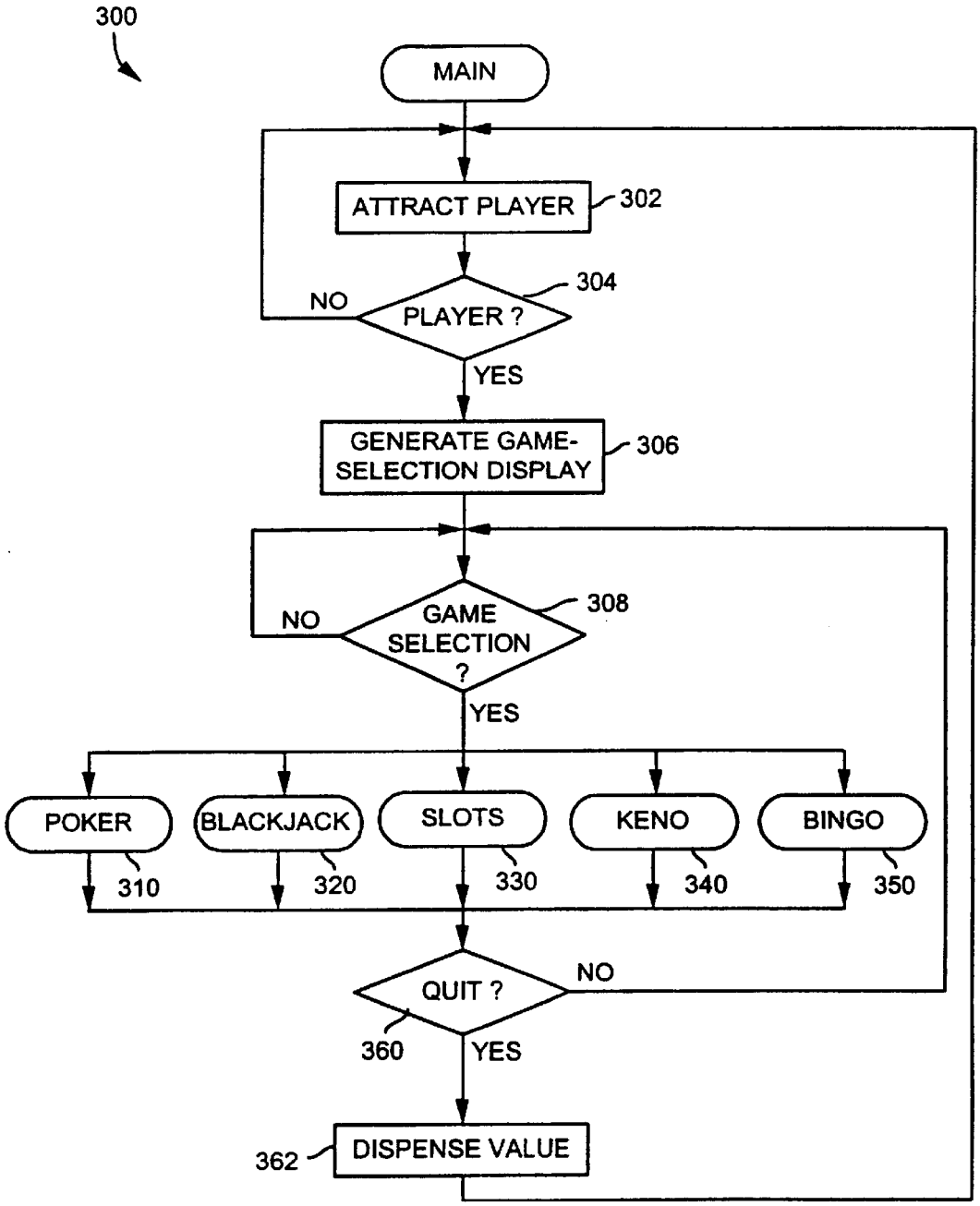
FIG. 4 is a flowchart of a main routine that may be performed by the controller shown in FIG. 2.

FIG. 4 is a flowchart of a main operating routine 300 that may be stored in the memory of the controller 260 and used to display images on the first and second displays 50, 54. Referring to FIG. 4, the main routine 300 may begin execution at block 302 at which player attraction graphics may be displayed by the first and/or second display 50/54 at the viewing area 222 (FIG. 2). Player attraction graphics may include a scrolling list of casino games that may be played on the gaming apparatus 42, cartoons, videos, etc. While the graphics are being displayed in the attraction mode, the controller 260 may intermittently check to see if a player is detected at block 304. Such an act may be carried out, for example, by polling the value-accepting devices 240, 242, 244, one of the input devices 228, or touchscreen 229 (FIG. 2), if provided. Alternatively, the value-accepting devices 240, 242, 244, touch-sensitive devices 228, and the touchscreen 229 may be programmed to notify the controller 260 when valid currency is inserted or player contact is detected, respectively. As long as no player is detected, the attraction graphics may be shown at block 302.

At block 306, a game-selection graphic may be shown on the first or second display 50/54 to the player. The game-selection graphic may include a list of casino games that may be played on the electronic gaming apparatus 42. Additionally, the player may be prompted to deposit value into the electronic gaming apparatus 42, via one of the value-accepting devices 240, 242, 244. The routine 300 may not proceed past the block 306 until the player deposits at least the minimum value required for the gaming apparatus 42. Any value that the player deposits may be stored as credit.

In response to the detection of a deposit of currency or other value by the player, the controller 260 may cause a message to be shown on the first or second display 50/54 prompting the player to select one of a number of video casino games. Upon detection of a player selection at block 308, the controller 260 may cause one of a number of casino game routines to be performed to allow the player to play a selected casino game. For example, the casino game routines could include a poker routine 310, a blackjack routine 320, a slots routine 330, a keno routine 340, and a bingo routine 350.

It should be noted that although five casino game routines are shown in FIG. 4, a different number of routines could be included to allow play of a different number of casino games. Alternatively, the gaming apparatus 42 may be programmed to allow play of only one type of casino game.

After one of the routines 310, 320, 330, 340, 350 has been performed to allow the player to play one of the games, block 360 may be utilized to determine whether the player wishes to terminate play on the gaming apparatus 42 or to select another game. If the player wishes to stop playing the electronic gaming apparatus 42, which wish may be expressed, for example, by selecting a quit graphic displayed on the first or second display 50/54 or through another input device, the controller 260 may dispense value to the player at block 362, based on the outcome of the games played by the player. The controller 260 may then cause the first or second display 50/54 to display attraction graphics to attract another player. If the player did not wish to quit as determined at block 360, the program may branch back to block 308 where another game selection may be made by the player.

From the above, it will be appreciated that the controller 260 may be programmed to display an image on either of the first and second displays 50, 54. In one embodiment having a normal mode of operation, for example, the controller 260 may cause an image to be displayed on the second display 54 only. The controller 260 may further be programmed with a bonus mode, in which the controller 260 causes an image to be displayed on the first display 50 only. The displays may be reversed, where in the normal mode the image is displayed on the first display 50 and in the bonus mode the image is displayed on the second display 54. Where the second display is a mechanical display, as in FIG. 3A, the controller 260 is programmed to activate the backlight 64, so that the image generated by the mechanical display is adequately illuminated. The images from the first and second displays 50, 54 are directed to the same viewing area 222, 50 that the customer need not shift his attention between different areas as the gaming apparatus 42 transitions between normal and bonus modes.

In addition, the multiple displays may be used to create a composite image consisting of image components from the first and second displays 50, 54. To generate a composite image, both of the first and second displays 50, 54 are operated simultaneously to create a visible image component. The first display 50 may create an actual image 5 component, while the second display 54 is reflected to create a virtual image component. As best understood with reference to FIGS. 3A and 3B, the virtual image component is located at or near the position of the actual image component. As a result, the composite image may appear to be three-dimensional. In addition, one of the image components may comprise an animated sequence, so that a mechanical display such as the second display 54 may be overlayed with a moving video image from a video display, such as the first display 50. Thus the image produced by the mechanical display, which is normally stationary, may be enhanced by the video image to appear animated. A similar composite image, with or without the three-dimensional effect, may be provided by the dual electronic displays provided in the embodiment of FIG. 3B.

Poker

Figure 5:
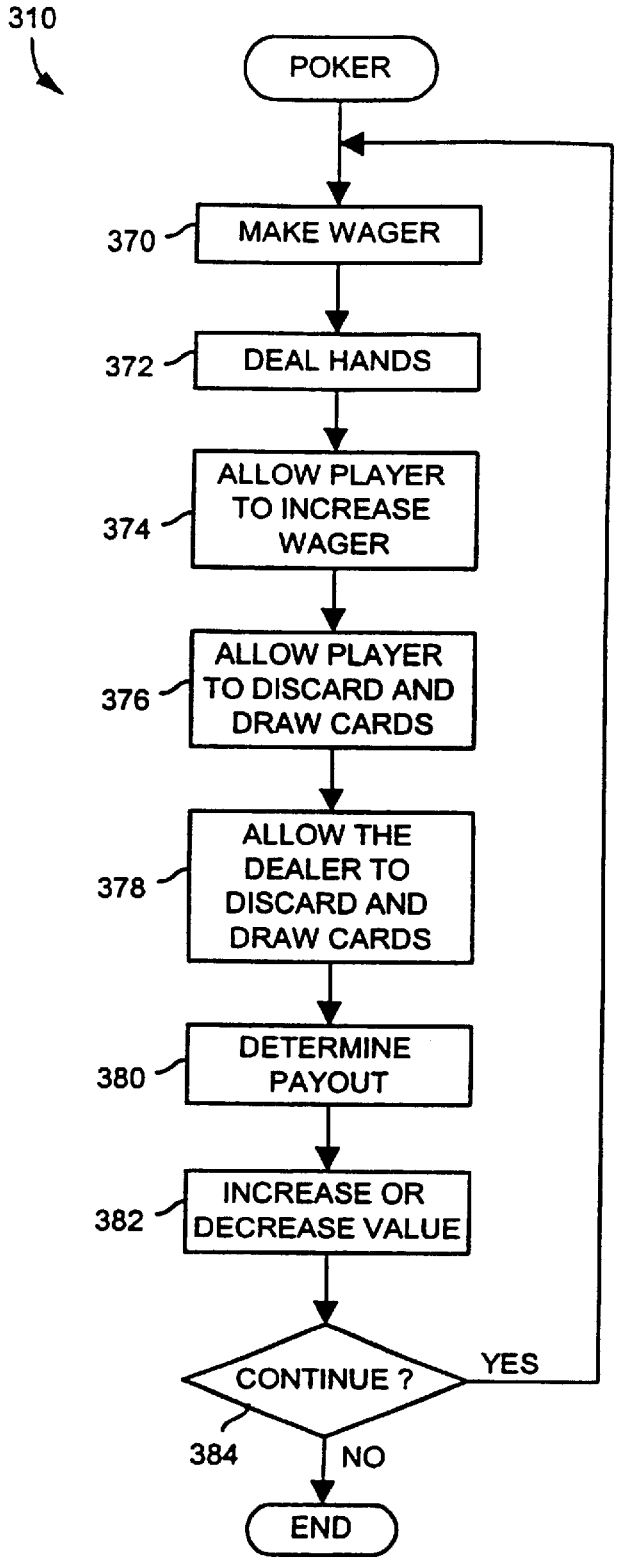
FIG. 5 is a flowchart of a poker routine that may be performed by the controller of FIG. 2.

FIG. 5 is a flowchart of the poker routine 310 shown schematically in FIG. 4. While the poker routine described herein is directed to a video poker game displayed on an electronic display, it will be appreciated that a similar poker routine may be provided on a mechanical display. Referring to FIG. 5, at block 370 the controller 260 may cause a display to be generated on the first or second display 50/54 to prompt the player to make a wager. After a wager is entered, the controller 260 may cause a pair of virtual poker hands of cards to be "dealt" to the player and to the dealer at block 372 by causing the first or second display 50/54 to display the virtual hands. After the virtual hands have been "dealt," the player may have an opportunity at block 374 to increase the initial wager made at the block 370. At block 376, the player may be allowed to discard and draw new cards in an attempt to improve the player's poker hand, and at block 378 the dealer (which may be, for example, the electronic gaming apparatus 42) may be allowed to discard and draw new cards in an attempt to improve the dealer's poker hand.

At block 380, the controller 260 may determine the outcome of the poker game and a corresponding payout. If the player has won the game (i.e. the player's hand is better than the dealer's hand), the payout will be positive. If the player has not won the game, the player may forfeit the wager(s) made at the blocks 370 and/or 374. At block 382, the controller 260 may increase or decrease the player's value based on the results of the poker game as determined at the block 380. At block 384, the controller 260 may cause a message to be displayed on the first or second display 50/54 asking whether the player desires to continue playing the video poker game. If so, the routine may branch back to block 370. If not, the poker routine 310 may end and the controller 260 may cause block 360 of FIG. 4 to be performed.

Figure 6:
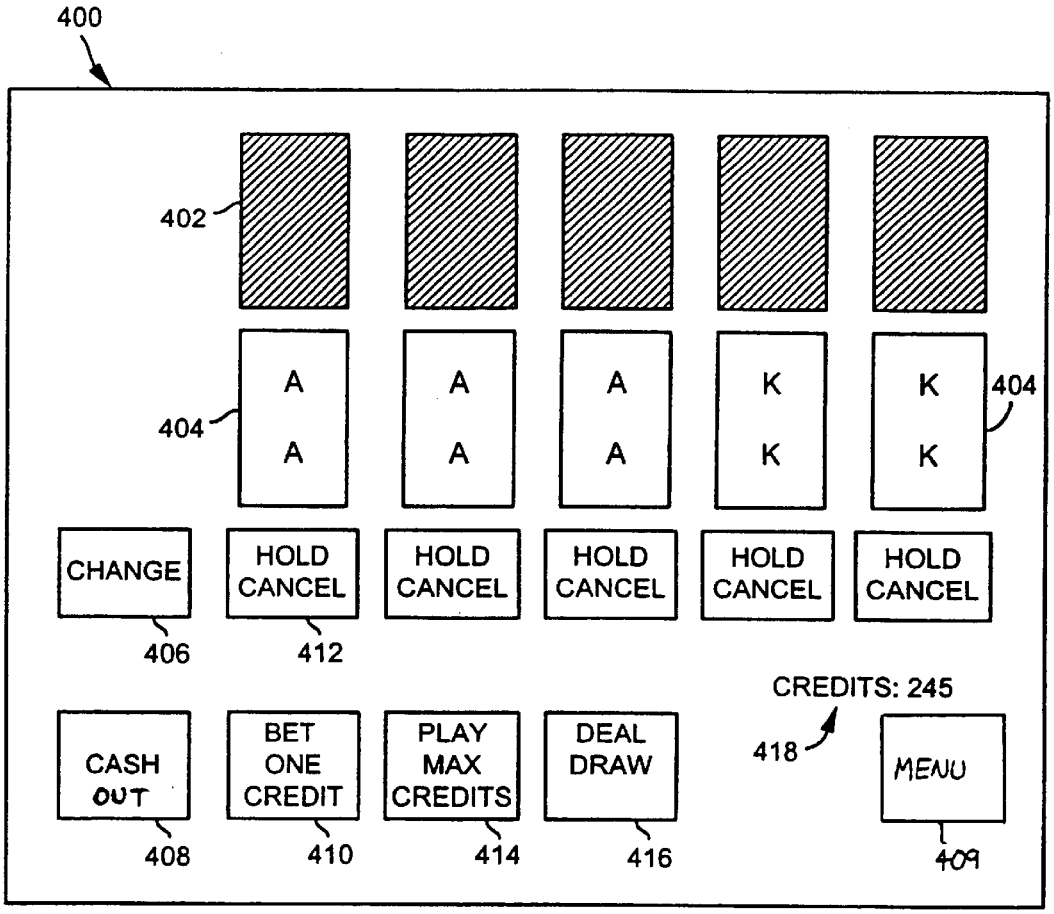
FIG. 6 is an illustration of a visual display that may be displayed when the controller of FIG. 2 performs the poker routine of FIG. 5.

FIG. 6 illustrates an exemplary display 400 that may be shown on the first or second display 50/54 during performance of the poker routine 310. Referring to FIG. 6, the display 400 may include video images representative of a plurality of cards 402 in a dealer's hand, which may be shown face down, and a plurality of cards 404 in a player's hand, which may be shown face up. To allow the player to control the play of the poker game, a plurality of player-selectable button graphics may be displayed. For example, button graphics for change 406, cash out 408, menu 409, and bet one credit 410 may be displayed. Further, button graphics for hold/cancel 412 may be displayed, each of which may pertain to a particular one of the player's cards 404. Button graphics for play max credits 414 and deal/draw 416 may also be displayed. A graphic 418 representing the number of player credits may also be displayed to inform the player of the number of credits that he or she has remaining.

In the embodiment illustrated in FIG. 3B, where both the first and second displays 50, 54 are electronic displays, a composite image having a three-dimensional effect may be provided. The three dimensional image may be formed by the first display 50 displaying a portion of the card images or other graphics, while the second display 54 displays other portions of the card images or other graphics. For example, the first display 50 may display images of blank playing cards, while the second display 54 may display images of the card symbols (i.e., the number and suit graphics) aligned with the blank playing card images. The first and second displays 50, 54 are positioned with respect to the beam splitter 58 so that the respective image portions appear layered, thereby creating the three-dimensional effect.

Blackjack

Figure 7:
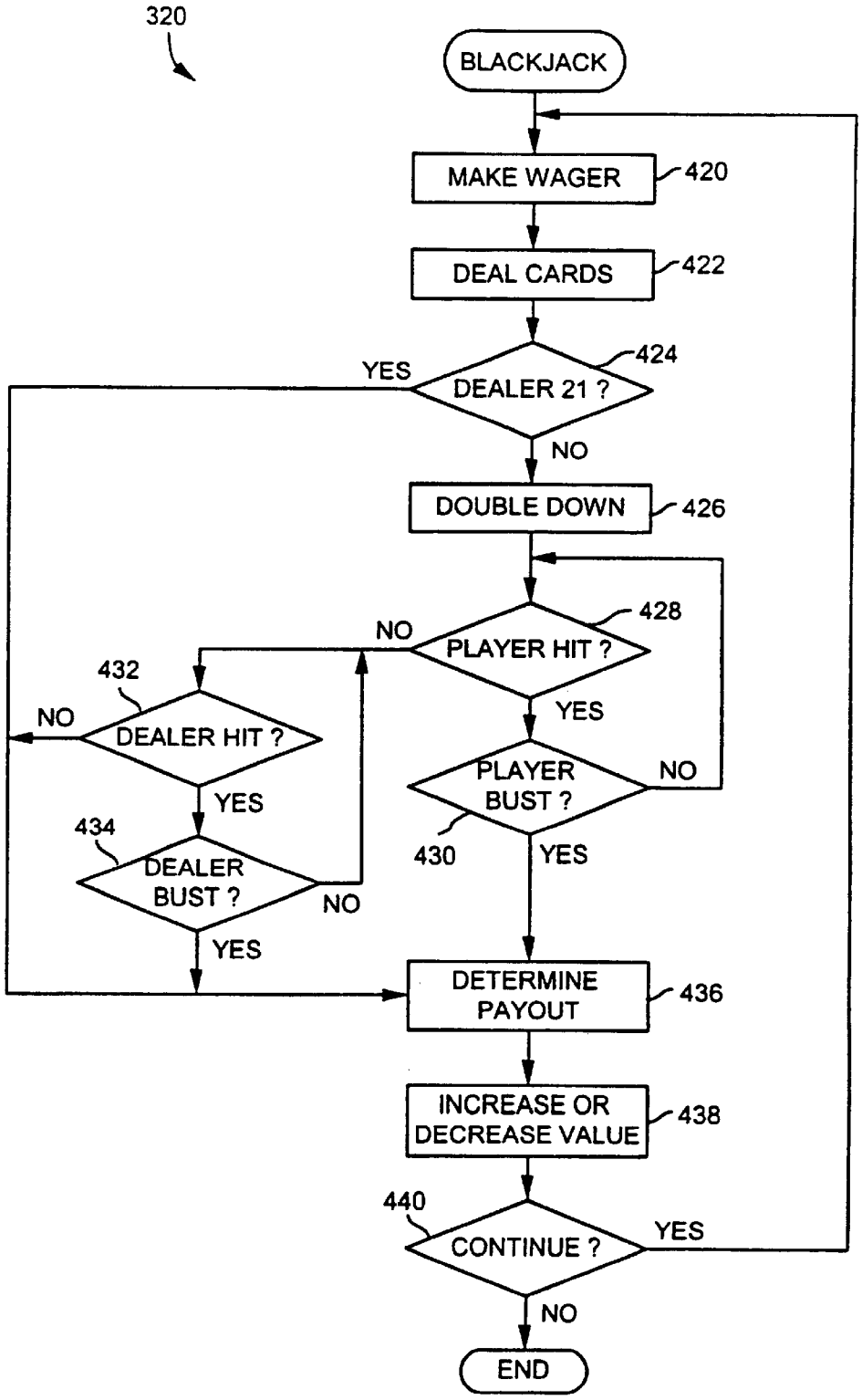
FIG. 7 is a flowchart of blackjack routine that may be performed by the controller of FIG. 2.

FIG. 7 is a flowchart of the blackjack routine 320 shown schematically in FIG. 4. While the blackjack routine described herein is directed to a video blackjack game displayed on an electronic display, it will be appreciated that a similar blackjack routine may be provided for a mechanical display. Referring to FIG. 7, the blackjack routine 320 may begin at block 420 at which a player may make a wager on the outcome of the blackjack game. After the player has made a wager, at block 422 the controller 260 may cause virtual cards to be "dealt" to both the player and the dealer (which may be the gaming apparatus 42), against which the player is playing.

After the cards are dealt, at block 424 the controller 260 may determine whether the dealer has a hand that totals 21. If the dealer's hand is not 21, at block 426 the controller 260 may cause the first or second display 50/54 to generate a display asking whether the player would like to double down. At block 428, the controller 260 may allow the player to be "hit" (i.e. dealt an additional virtual card). If the player is hit, block 430 may determine if the player has "bust" (i.e. has exceeded 21). If the player has not bust, block 268 may be performed again to allow the player to be "hit" again.

If the player decides not to hit, at block 432 the controller 260 may determine whether the dealer wants to be hit. If the dealer hits, at block 434 the controller 260 may determine whether the dealer has bust. If the dealer has not bust, block 432 may be performed again to allow the dealer to be "hit" again. If the dealer decides not to hit, at block 436 the controller 260 may determine the outcome of the blackjack game and a corresponding payout. For example, the controller 260 may determine which of the player or the dealer has the higher hand that does not exceed 21.

At block 438, the controller 260 may increase or decrease the player's value based on the results of the blackjack game as determined at the block 436. At block 440, the controller 260 may cause a message to be displayed on the first or second display 50/54 asking whether the player desires to continue playing the video blackjack game. If so, the routine may branch back to block 420. If not, the blackjack routine 320 may end and the controller 260 may cause block 360 of FIG. 9 to be performed.

Figure 8:
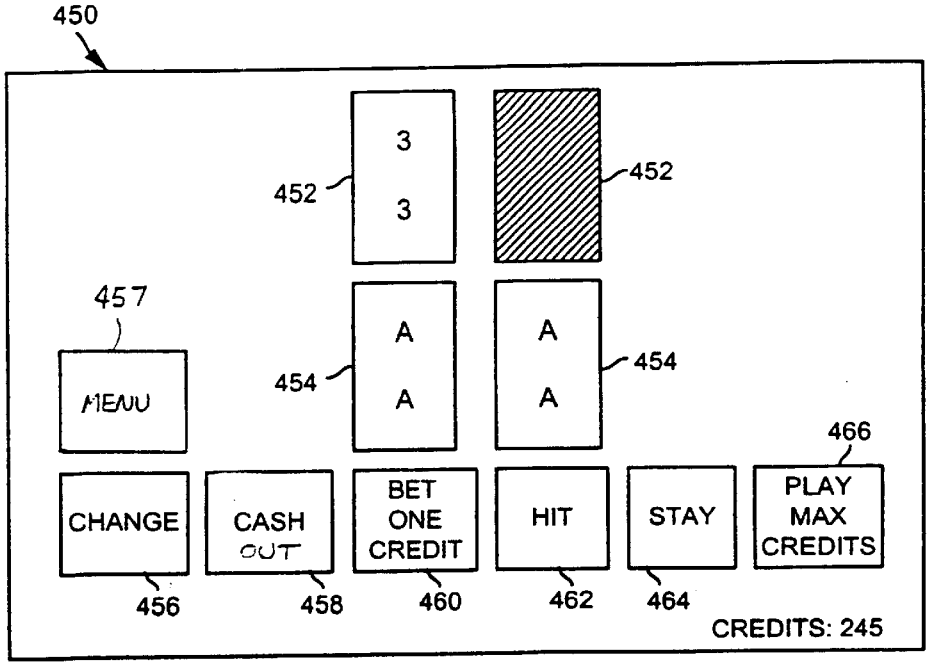
FIG. 8 is an illustration of a visual display that may be displayed when the controller of FIG. 2 performs the blackjack routine of FIG. 7.

FIG. 8 illustrates an exemplary display 450 that may be shown on the first or second display 50/54 during performance of the blackjack routine 320. Referring to FIG. 8, the display 450 may include video images representative of a plurality of cards 452 that form a dealer's blackjack hand and a plurality of cards 454 that form the player's blackjack hand. To allow the player to control the play of the blackjack game, a plurality of player-selectable button graphics may be displayed and may be operable using a touchscreen. For example, button graphics for change 456, menu 457, cash 10 out 458, bet one credit 460, hit 462, stay 464 and/or play max credits 466 may be provided.

As described above with respect to the poker routine 310, a three dimensional effect may be generated by the embodiment illustrated in FIG. 3B, where both the first and second displays 50, 54 are electronic displays. For example, the first display 50 may display images of blank playing cards, while the second display 54 may display images of the card symbols (i.e., the number and suit graphics) aligned with the blank playing card images.

Slots

Figure 9:
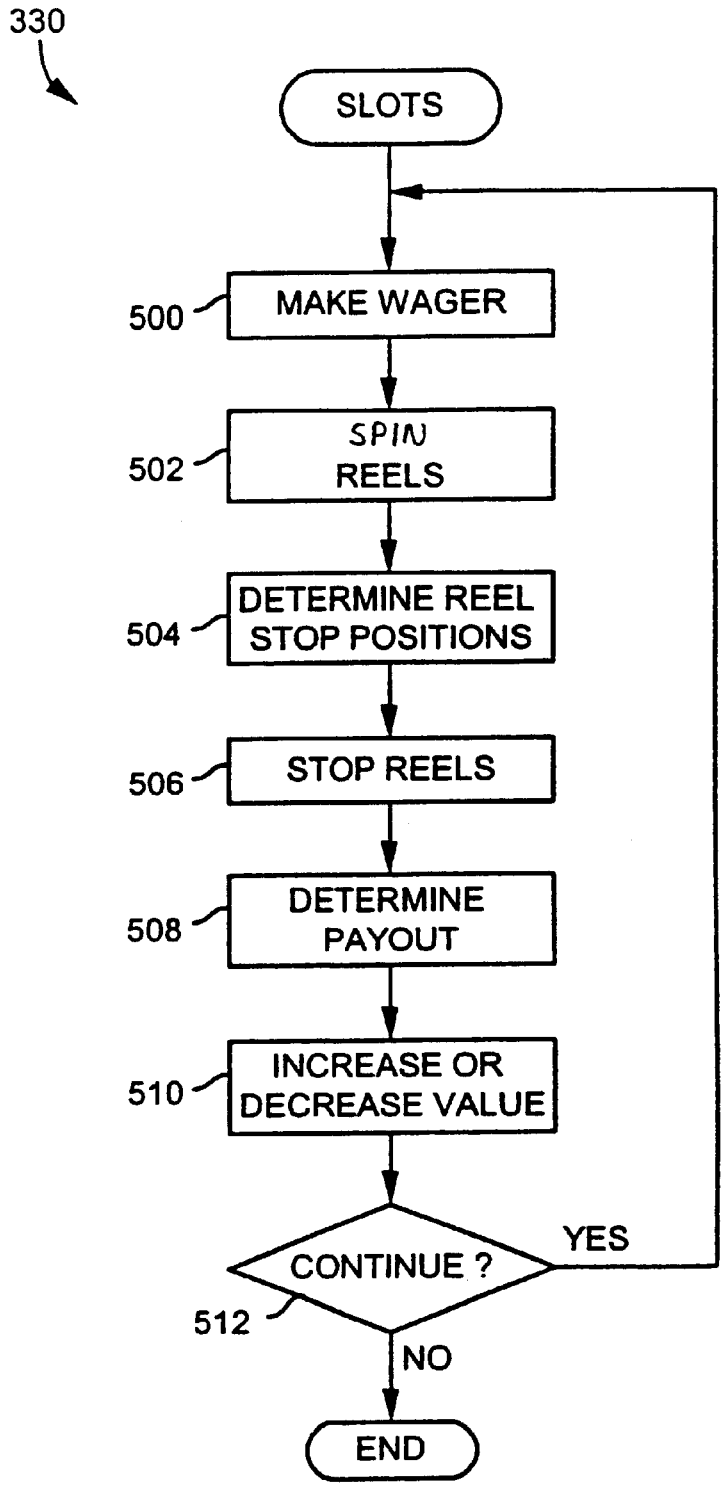
FIG. 9 is a flowchart of a slots routine that may be performed by the controller of FIG. 2.

FIG. 9 is a flowchart of the slots routine 330 shown schematically in FIG. 4. While the slots routine described herein is directed to a mechanical slot game displayed on a mechanical display, it will be appreciated that a similar slot routine may be provided for an electronic display. Referring to FIG. 9, the slots routine 330 may begin at block 500 at which a player may make a wager. After the player has made a wager, at block 502 the controller 260 may cause the stepper reels of a mechanical display, which may be the first or the second display 50/54, to spin. While the reels are spinning, at block 504 the controller 260 may determine the symbols on which the various reels are to be stopped, such as by randomly selecting one or more numbers from which the reel stop positions are determined. At block 506, the controller 260 may cause the reels of the first or second display 50/54 to stop from left to right, from the perspective of the player, or in any other manner or sequence. At block 508, the controller 260 may evaluate the game outcome based on the positions at which the reels stopped and determine the payout to which the player is entitled. For example, if the reels have stopped on high payout symbols, the player may receive a large payout. If, however, the reels have stopped on symbols having no payout, the player loses the money that was wagered at the block 500.

At block 510, the controller 260 may increase or decrease the player's value based on the results of the slots game as determined at the block 508. At block 512, the controller 260 may cause a message to be displayed on the first or second display 50/54 asking whether the player desires to continue playing the slots game. If so, the routine may branch back to block 500. If not, the video slots routine 330 may end and the controller 260 may cause block 360 of FIG. 4 to be performed.

Figure 10:
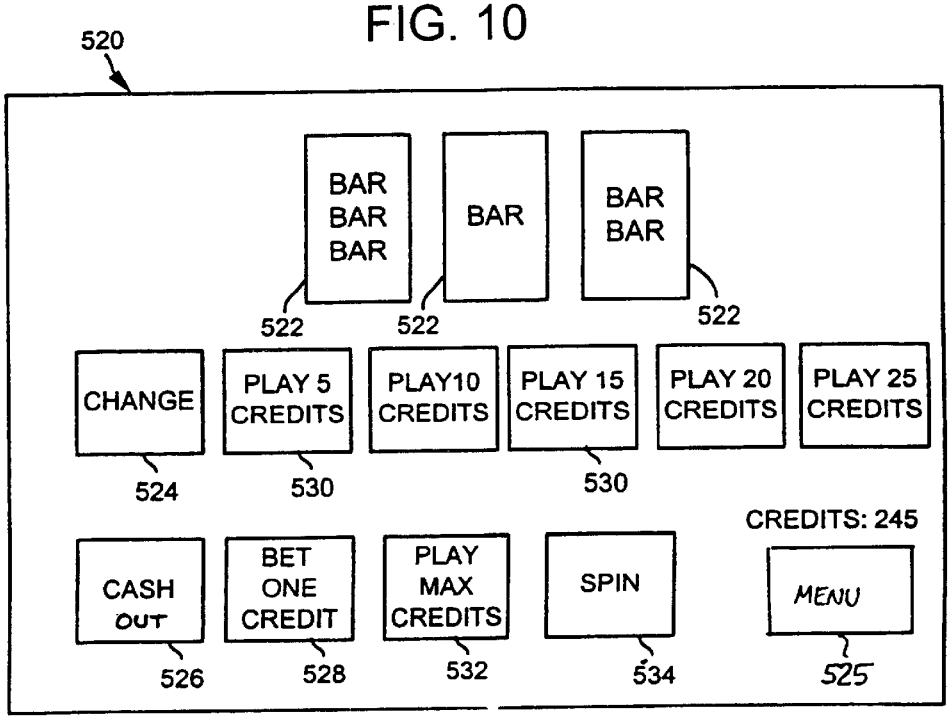
FIG. 10 is an illustration of a visual display that may be displayed when the controller of FIG. 2 performs the slots routine of FIG. 9.

FIG. 10 illustrates an exemplary display 520 that may be shown by the first and second displays 50, 54 during performance of the slots routine 330. Referring to FIG. 10, the display 520 may include a plurality of slot machine reels 522 of a mechanical display. While three such slot machine reels 522 are shown in FIG. 10, it should be understood that any number of reels could be used. To allow the player to control the play of the slot machine, a plurality of player-selectable button graphics may be displayed by an electronic display. For example, button graphics for change 524, menu 525, cash out 526, bet one credit 528, bet various numbers of credits 530, play max credits 532, and/or spin reels 534 may be displayed, and may be operable via a touchscreen 229.

The first display 50 may be the video display and the second display may be the mechanical display, as shown in FIG. 3A, or the mechanical and video displays may be switched. The video display may also show graphical images such as bet lines, meter information, and may also be used to display a bonus round or game. In addition, two video displays may be provided, as shown in FIG. 3B, in which the display showing the mechanical stepper reels is replaced by a video display showing virtual stepper reel images.

Keno

Figure 11:
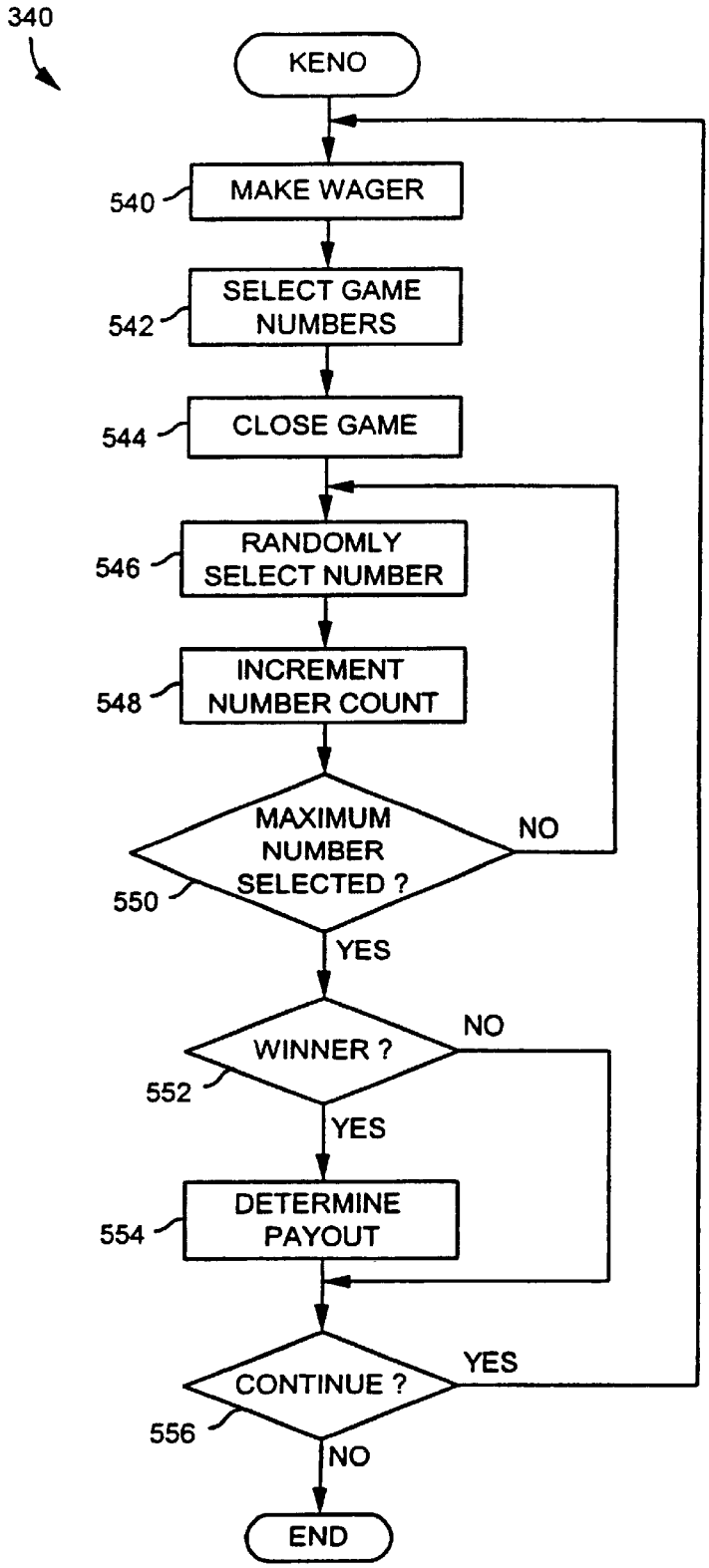
FIG. 11 is a flowchart of a keno routine that may be performed by the controller of FIG. 2.

FIG. 11 is a flowchart of the keno routine 340 shown schematically in FIG. 4. The keno routine 340 may be utilized in connection with a single gaming apparatus 42 where a single player is playing a keno game, or the keno routine 340 may be utilized in connection with multiple gaming apparatuses 42 where multiple players are playing a single keno game. In the latter case, one or more of the acts described below may be performed either by the controller 260 in each gaming apparatus or by a central computer (not shown) to which multiple gaming apparatuses 42 are operatively connected, such as by a network or other data link, for example.

Referring to FIG. 11, the keno routine 340 may begin at block 540 at which a player makes a wager on the outcome of the keno game. After the player has made a wager, at block 542 the player may select one or more game numbers, which may be within a range set by the casino. After being selected, the player's game numbers may be stored in the memory of the controller 260.

At block 544, after a certain amount of time, the keno game may be closed to additional players (where a number of players are playing a single keno game using multiple gaming apparatuses 42) and/or additional game numbers for a single player. At block 546, a game number within a range set by the casino may be randomly selected either by the controller 260 or a central computer operatively connected to the controller. The randomly selected game number may be displayed on the first or second display 50/54 and the displays of other gaming apparatuses 42 (if any) which are involved in the same keno game. At block 548, the controller 260 (or the central computer noted above) may increment a count which keeps track of how many game numbers have been selected at block 546.

At block 550, the controller 260 (or the central computer noted above) may determine whether a maximum number of game numbers within the range have been randomly selected. If not, another game number may be randomly selected at block 546. If the maximum number of game numbers has been selected, at block 552 the controller 260 (or a central computer) may determine whether there are a sufficient number of matches between the game numbers selected by the player and the game numbers randomly selected at block 546 to cause the player to win. The number of matches may depend on how many numbers the player selected and the particular keno rules being used.

If there are a sufficient number of matches, a payout may be determined at block 554 to compensate the player for winning the game. The payout may depend on the number of matches between the game numbers selected by the player and the game numbers randomly selected at block 546. At block 556, the controller 260 may cause a message to be displayed on the first or second display 50/54 asking whether the player desires to play another keno game. If so, the routine may branch back to block 540. If not, the keno routine 340 may end and the controller 260 may cause block 360 of FIG. 4 to be performed.

Figure 12:
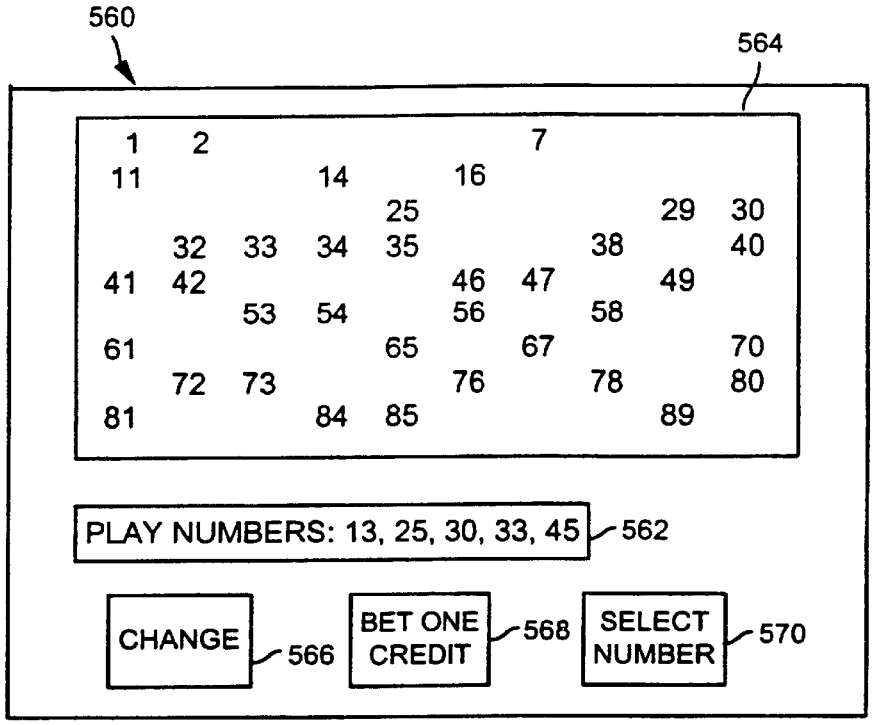
FIG. 12 is an illustration of a visual display that may be displayed when the controller of FIG. 2 performs the keno routine of FIG. 11.

FIG. 12 illustrates an exemplary display 560 that may be shown on the first or second display 50/54 during performance of the video keno routine 340. Referring to FIG. 12, the display 560 may include a video image 562 of a plurality of numbers that were selected by the player and a video image 564 of the randomly numbers randomly selected during the keno game. The randomly selected numbers may be displayed in a grid pattern. To allow the player to control the play of the keno game, a plurality of player-selectable button graphics may be displayed, such as a change graphic 566, a bet-one-credit graphic 568, and a select number graphic 570.

Figure 13:
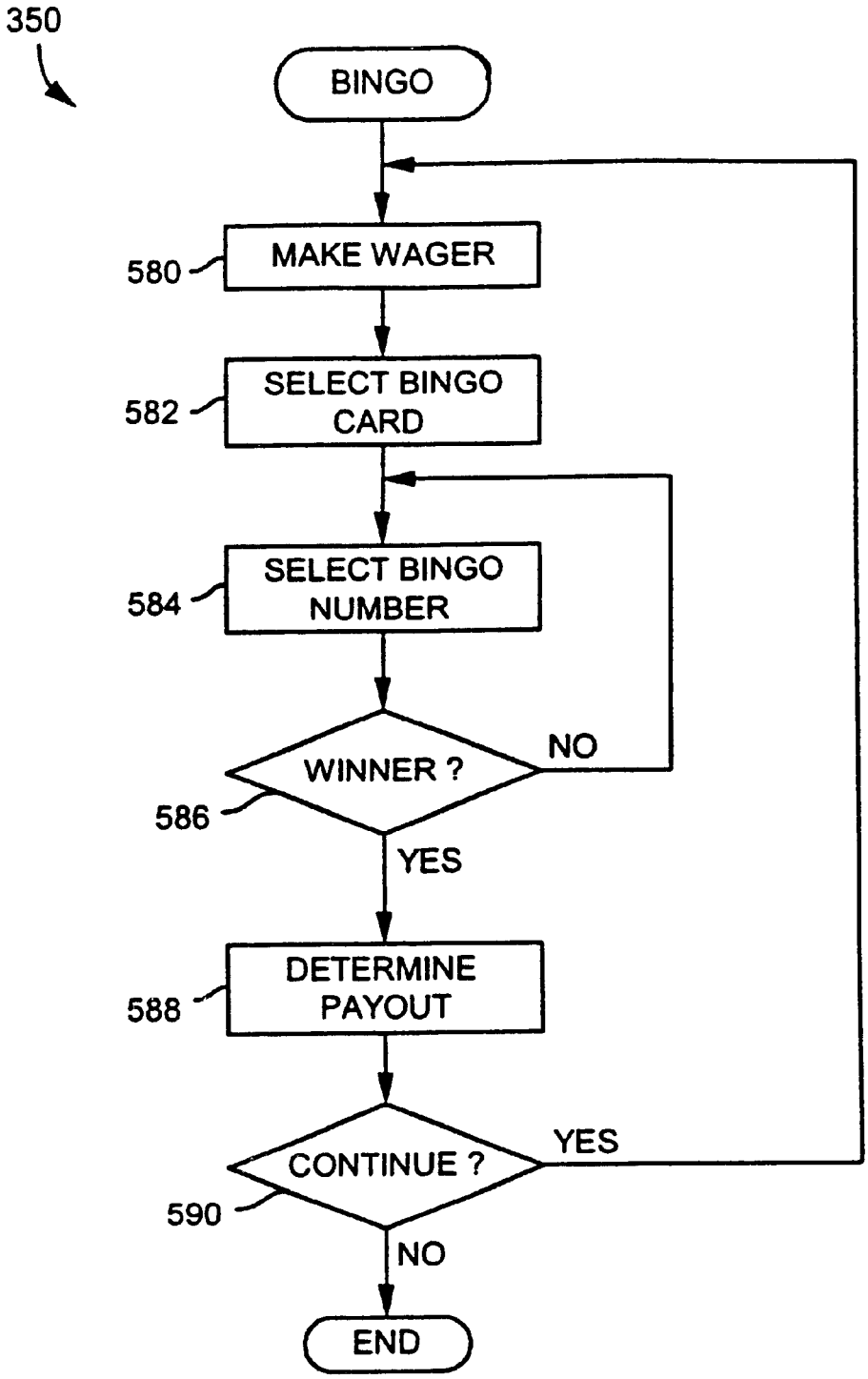
FIG. 13 is a flowchart of a bingo routine that may be performed by the controller of FIG. 2.

FIG. 13 is a flowchart of the bingo routine 350 shown schematically in FIG. 4. The bingo routine 350 may be utilized in connection with a single gaming apparatus 42 where a single player is playing a bingo game, or the bingo routine 350 may be utilized in connection with multiple gaming apparatuses 42 where multiple players are playing a single bingo game. In the latter case, one or more of the acts described below may be performed either by the controller 260 in each gaming apparatus 42 or by a central computer (not shown) to which multiple gaming apparatuses 42 are operatively connected, such as by a network or other data link, for example.

Referring to FIG. 13, at block 580 the controller 260 may prompt a player to make a wager on the outcome of the bingo game by causing a message to be displayed on the first or second display 50/54. At block 582, the player may select a bingo card, which may be generated randomly. The player may select more than one bingo card, and there may be a maximum number of bingo cards that a player may select. At block 584, a bingo number may be randomly generated by the controller 260 or a central computer. The bingo number may be communicated to the first or second display 50/54 and to the displays of any other gaming apparatuses 42 involved in the bingo game.

At block 586, the controller 260 (or a central computer) may determine whether the player has won according to any set of bingo rules. If no player has won, another bingo number may be randomly selected at block 584. At block 586, if a player has bingo (which may be determined by the controller 260), at block 588 a payout for the winning player may be determined. The payout may depend on the number of random. numbers that were drawn before there was a winner, the total number of winners (if there was more than one player), and the amount of money that was wagered on the game.

Figure 14:
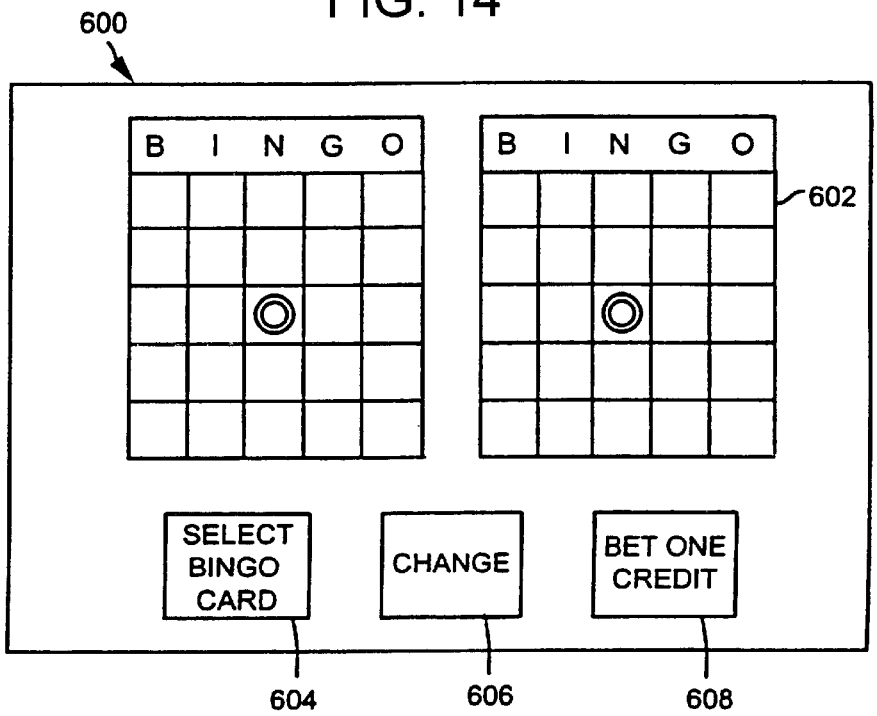
FIG. 14 is an illustration of a visual display that may be displayed when the controller of FIG. 2 performs the bingo routine of FIG. 13.

FIG. 14 illustrates an exemplary display 600 that may be shown on the first or second display 50/54 during performance of the video bingo routine 350. Referring to FIG. 14, the display 600 may include a video image 602 of one or more bingo cards and images of the bingo numbers selected during the game. The bingo cards may have a grid pattern. To allow the player to control the play of the video bingo game, a plurality of user-selectable button graphics may be displayed, such as a select bingo card graphic 604, a change graphic 606, and/or a bet one credit graphic 608.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A gaming apparatus, comprising:

a cabinet having a first interior portion and a second interior portion, the cabinet further including an opening defining a viewing area;

a partially reflective optical device supported inside the cabinet, the partially reflective optical device being positioned to transmit light from the first interior portion to the viewing area and reflect light from the second interior portion to the viewing area;

a first display supported inside the cabinet in the first interior portion;

a second display supported inside the cabinet in the second interior portion; and a controller operatively coupled to the first and second displays, the controller comprising a processor and a memory operatively coupled to the processor, the controller being programmed to allow a person to make a wager, the controller being programmed to cause a first image associated with a casino game to be selectively generated on the first display, and a second image associated with a casino game to be selectively generated on the second display, and the controller being programmed to determine an outcome of the casino game represented by the first and second images and to determine a value payout associated with the outcome of the casino game.

2. The gaming apparatus as defined in claim 1, in which the controller is further programmed with a normal mode, during which the second image is generated on the second display, and a bonus mode, during which the first image is generated on the first display.

3. The gaming apparatus as defined in claim 1, in which the controller is programmed to simultaneously generate the first image on the first display and the second image on the second display, thereby to produce a composite image at the viewing area.

4. The gaming apparatus as defined in claim 3, in which the composite image comprises a three dimensional image.

5. The gaming apparatus as defined in claim 3, in which the first display comprises an electronic display and the second display comprises a mechanical display, and in which the first image generated by the first display comprises an animated sequence.

6. The gaming apparatus as defined in claim 5, in which the mechanical display comprises a backlight operatively connected to the controller, wherein the controller is further programmed to illuminate the backlight when the second image is generated by the mechanical display.

7. The gaming apparatus as defined in claim 1, in which the partially reflective optical device comprises a beam splitter.

8. The gaming apparatus as defined in claim 1, in which the first and second displays comprise first and second electronic displays, respectively.

9. The gaming apparatus as defined in claim 1, further comprising a touchscreen for generating input, wherein the controller is operably coupled to the touchscreen for receiving the input.

10. A gaming apparatus, comprising:

a cabinet having a first interior portion and a second interior portion, the cabinet further including an opening defining a viewing area;

a beam splitter supported inside the cabinet and positioned to transmit light from the first interior portion to the viewing area and reflect light from the second interior portion to the viewing area;

an electronic display supported inside the cabinet in the first interior portion;

a mechanical display supported inside the cabinet in the second interior portion; and a controller operatively coupled to the electronic and mechanical displays, the controller comprising a processor and a memory operatively coupled to the processor, the controller being programmed to allow a person to make a wager, the controller being programmed to cause a first image associated with a video casino game to be generated on the electronic display, the controller being programmed to cause a second image associated with a casino game to be generated on the mechanical display, and the controller being programmed to determine an outcome of the casino game represented by the first and second images and to determine a value payout associated with the outcome of the casino game.

11. The gaming apparatus as defined in claim 10, in which the controller is further programmed with a normal mode, during which the second image is generated on the mechanical display, and a bonus mode, during which the first image is generated on the electronic display.

12. The gaming apparatus as defined in claim 10, in which the controller is programmed to simultaneously generate the first image and the second image, thereby to produce a composite image at the viewing area.

13. The gaming apparatus as defined in claim 12, in which the composite image comprises a three-dimensional image.

14. The gaming apparatus as defined in claim 12, in which the first image generated by the electronic display comprises an animated sequence.

15. The gaming apparatus as defined in claim 10, in which the mechanical display comprises a backlight operatively connected to the controller, wherein the controller is further programmed to illuminate the backlight when the second image is generated by the mechanical display.

16. The gaming apparatus as defined in claim 10, in which the first and second displays comprise first and second electronic displays, respectively.

17. A gaming apparatus, comprising:

a cabinet having a first interior portion and a second interior portion, the cabinet further including an opening defining a viewing area;

a beam splitter supported inside the cabinet and positioned to transmit light from the first interior portion to the viewing area and reflect light from the second interior portion to the viewing area;

an electronic display supported inside the cabinet in the first interior portion;

a mechanical display supported inside the cabinet in the second interior portion; and a controller operatively coupled to the electronic and mechanical displays, the controller comprising a processor and a memory operatively coupled to the processor, the controller being programmed to allow a person to make a wager, the controller being programmed to cause a first image associated with a video casino game to be generated on the electronic display, the first image representing a video casino game selected from one of the group of video casino games consisting of video poker, video blackjack, video slots, video keno, and video bingo, the first image comprising an image of at least five playing cards if the video casino game is video poker, the first image comprising an image of a plurality of simulated slot machine reels if the video casino game is video slots, the first image comprising an image of a plurality of playing cards if the video casino game is video blackjack, the first image comprising an image of a plurality of keno numbers if the video casino game is video keno, and the first image comprising an image of a bingo grid if the video casino game is video bingo, the controller being programmed to cause a second image associated with a casino game to be generated on the mechanical display, the image representing a casino game selected from one of the group of casino games consisting of poker, blackjack, slots, keno, and bingo, the second image comprising an image of at least five playing cards if the casino game is poker, the second image comprising an image of a plurality of slot machine reels if the casino game is slots, the second image comprising an image of a plurality of playing cards if the casino game is blackjack, the second image comprising an image of a plurality of keno numbers if the casino game is keno, and the second image comprising an image of a bingo grid if the casino game is bingo, and the controller being programmed to determine an outcome of the casino game represented by the first and second images and to determine a value payout associated with the outcome of the casino game.

18. A gaming apparatus, comprising:

a cabinet having a first interior portion and a second interior portion, the cabinet further including an opening defining a viewing area;

a beam splitter supported inside the cabinet and positioned to transmit light from the first interior portion to the viewing area and reflect light from the second interior portion to the viewing area;

a first electronic display supported inside the cabinet in the first interior portion;

a second electronic display supported inside the cabinet in the second interior portion; and a controller operatively coupled to the first and second electronic displays, the controller comprising a processor and a memory operatively coupled to the processor, the controller being programmed to allow a person to make a wager, the controller being programmed to cause a first image associated with a video casino game to be selectively generated on the first electronic display, the controller being programmed to cause a second image associated with a casino game to be selectively generated on the second electronic display, and the controller being programmed to determine an outcome of the casino game represented by the first and second images and to determine a value payout associated with the outcome of the casino game.

19. The gaming apparatus as defined in claim 18, in which the controller is further programmed with a normal mode, during which the second image is generated on the second electronic display, and a bonus mode, during which the first image is generated on the first electronic display.

20. The gaming apparatus as defined in claim 18, in which the controller is programmed to simultaneously generate the first image and the second image, thereby to produce a composite image at the viewing area.

21. The gaming apparatus as defined in claim 20, in which the composite image comprises a three-dimensional image.

22. The gaming apparatus as defined in claim 20, in which the first image generated by the first electronic display comprises an animated sequence.

23. A gaming apparatus, comprising:

a cabinet having a first interior portion and a second interior portion, the cabinet further including an opening defining a viewing area;

a beam splitter supported inside the cabinet and positioned to transmit light from the first interior portion to the viewing area and reflect light from the second interior portion to the viewing area;

a first electronic display supported inside the cabinet in the first interior portion;

a second electronic display supported inside the cabinet in the second interior portion; and a controller operatively coupled to the first and second electronic displays, the controller comprising a processor and a memory operatively coupled to the processor, the controller being programmed to allow a person to make a wager, the controller being programmed to cause a first image associated with a video casino game to be generated on the first electronic display, the first image representing a video casino game selected from one of the group of video casino games consisting of video poker, video blackjack, video slots, video keno, and video bingo, the first image comprising an image of at least five playing cards if the video casino game is video poker, the first image comprising an image of a plurality of simulated slot machine reels if the video casino game is video slots, the first image comprising an image of a plurality of playing cards if the video casino game is video blackjack, the first image comprising an image of a plurality of keno numbers if the video casino game is video keno, and the first image comprising an image of a bingo grid if the video casino game is video bingo, the controller being programmed to cause a second image associated with a video casino game to be generated on the second electronic display, the second image representing a video casino game selected from one of the group of video casino games consisting of video poker, video blackjack, video slots, video keno, and video bingo, the second image comprising an image of at least five playing cards if the video casino game is video poker, the second image comprising an image of a plurality of slot machine reels if the video casino game is video slots, the second image comprising an image of a plurality of playing cards if the video casino game is video blackjack, the second image comprising an image of a plurality of keno numbers if the video casino game is video keno, and the second image comprising an image of a bingo grid if the video casino game is video bingo, and the controller being programmed to determine an outcome of the casino game represented by the first and second images and to determine a value payout associated with the outcome of the casino game.

24. A casino gaming method comprising:

allowing a person to make a wager;

generating a first image associated with a casino game on a first display;

transmitting the first image from the first display to a viewing area;

generating a second image associated with a casino game on a second display;

reflecting the second image from the second display to the viewing area;

controlling operation of the first and second displays to selectively show the first and second images;

determining an outcome of the casino game represented by the first and second images; and determining a value payout associated with the outcome of the casino game.

25. The method of claim 24, in which the controlling operation step comprises a normal mode operation in which the first image is displayed and a bonus mode operation in which the second image is displayed.

26. The method of claim 24, in which the first and second images are displayed during the controlling operation step to generate a composite image.

27. The method of claim 26, in which the composite image comprises a three dimensional image.

28. The method of claim 26, in which the first display comprises a mechanical display and the second display comprises an electronic display, and in which the second image generated by the second display comprises an animated sequence.

29. The method of claim 24, in which the first and second displays comprise first and second electronic displays, respectively.

30. A casino gaming method comprising:

allowing a person to make a wager;

generating a first image associated with a casino game on a first display, the first image representing a casino game selected from one of the group of casino games consisting of poker, blackjack, slots, keno, and bingo, the first image comprising an image of at least five playing cards if the casino game is poker, the first image comprising an image of a plurality of slot machine reels if the casino game is slots, the first image comprising an image of a plurality of playing cards if the casino game is blackjack, the first image comprising an image of a plurality of keno numbers if the casino game is keno, and the first image comprising an image of a bingo grid if the casino game is bingo;

transmitting the first image from the first display to a viewing area;

generating a second image associated with a casino game on a second display the second image representing a casino game selected from one of the group of casino games consisting of poker, blackjack, slots, keno, and bingo, the second image comprising an image of at least five playing cards if the casino game is poker, the second image comprising an image of a plurality of slot machine reels if the casino game is slots, the second image comprising an image of a plurality of playing cards if the casino game is blackjack, the second image comprising an image of a plurality of keno numbers if the casino game is keno, and the second image comprising an image of a bingo grid if the casino game is bingo;

reflecting the second image from the second display to the viewing area;

controlling operation of the first and second displays to selectively show the first and second images;

determining an outcome of the casino game represented by the first and second images; and determining a value payout associated with the outcome of the casino game.

31. The method of claim 30, in which the controlling operation step comprises a normal mode operation in which the first image is displayed and a bonus mode operation in which the second image is displayed.

32. The method of claim 30, in which the first and second images are displayed during the controlling operation step to generate a composite image.

33. The method of claim 32, in which the composite image comprises a threedimensional image.

34. The method of claim 32, in which the first display comprises a mechanical display and the second display comprises an electronic display, and in which the second image generated by the second display comprises an animated sequence.

35. The method of claim 30, in which the first and second displays comprise first and second electronic displays, respectively.

* * * * *

UNITED STATES PATENT AND TRADEMARK OFFICE

CERTIFICATE OF CORRECTION

PATENT NO. : 6,517,437 B1 
DATED : February 11, 2003
INVENTOR(S) : William R. Wells et al.

It is certified that error appears in the above-identified patent and that said Letters Patent is hereby corrected as shown below:

Column 16,
Line 41, please delete “display the” and replace it with -- display, the --.

Column 17,
Line 5, please delete “threedimensional image” and replace it with -- three-dimensional image --.

Signed and Sealed this

Thirtieth Day of September, 2003

JAMES E. ROGAN
*Director of the United States Patent and Trademark Office*